US005157442A

United States Patent [19]

Tanigawa et al.

[11] Patent Number: 5,157,442

[45] Date of Patent: Oct. 20, 1992

[54] IMAGE FORMING APPARATUS

[75] Inventors: Koichi Tanigawa, Tokyo; Akihiko Takeuchi, Kanagawa; Yasumasa Otsuka, Kanagawa; Hiroto Hasegawa, Kanagawa; Toshiyuki Yoshihara, Tokyo; Takayasu Yuminamochi, Kanagawa; Eiichi Imai, Chiba, all of Japan

[73] Assignee: Canon Kabushiki Kaisha, Tokyo, Japan

[21] Appl. No.: 516,665

[22] Filed: Apr. 30, 1990

[30] Foreign Application Priority Data

Apr. 28, 1989 [JP] Japan ..... 1-109526

[51] Int. Cl.[5] ..... G03G 15/09

[52] U.S. Cl. ..... 355/251; 118/653; 118/656; 118/658; 355/253; 430/111

[58] Field of Search ..... 355/245, 256-258, 355/251, 253, 269, 306, 307; 358/300; 346/153.1, 160; 430/106.6, 111; 118/644, 653, 656, 657, 658

[56] References Cited

U.S. PATENT DOCUMENTS

| | | | |
|---|---|---|---|
| 4,284,701 | 8/1981 | Abbott et al. | 430/111 |
| 4,292,923 | 10/1981 | Huggins | 118/658 |
| 4,434,220 | 2/1984 | Abbott et al. | 430/111 X |
| 4,448,870 | 5/1984 | Imai et al. | 430/107 |
| 4,554,234 | 11/1985 | Imai et al. | 430/122 |
| 4,592,987 | 6/1986 | Mitsuhashi et al. | 430/102 |
| 4,622,281 | 11/1985 | Imai et al. | 430/107 |
| 4,657,838 | 4/1987 | Fukumoto et al. | 430/110 |
| 4,663,263 | 5/1987 | Ikeda et al. | 430/110 |
| 4,702,986 | 10/1987 | Imai et al. | 430/120 |
| 4,741,984 | 5/1988 | Imai et al. | 430/106.6 |
| 4,803,514 | 2/1989 | Hiratsuka et al. | |
| 4,804,610 | 2/1989 | Mori et al. | 430/137 |
| 4,816,365 | 3/1989 | Ishikawa | 430/11 |
| 4,837,101 | 6/1989 | Gruber et al. | 430/169 |
| 4,883,017 | 11/1989 | Yuji et al. | 118/653 |
| 4,957,840 | 9/1990 | Sakashita et al. | 430/106.6 |
| 5,009,973 | 4/1991 | Yoshida et al. | 355/251 |
| 5,014,089 | 5/1991 | Sakashita et al. | 355/251 |

FOREIGN PATENT DOCUMENTS

| | | |
|---|---|---|
| 0207628 | 1/1989 | European Pat. Off. . |
| 2611281 | 8/1988 | France . |
| 1-219848 | 9/1989 | Japan . |

OTHER PUBLICATIONS

*Patent Abstracts of Japan*, vol. 13, No. 363, Aug. 14, 1989, p. 918, Abstract No. 3711, Matsubara, Akitoshi, "Developer for Electrostatic Image".

*Patent Abstracts of Japan*, vol. 5, No. 122, Aug. 7, 1981, p. 74, Abstract No. 794, Katoh, Shigeo, "Magnetic Developer".

*Primary Examiner*—A. T. Grimley

*Assistant Examiner*—Matthew S. Smith

*Attorney, Agent, or Firm*—Fitzpatrick, Cella, Harper & Scinto

[57] ABSTRACT

An image forming apparatus has a charging device for charging a photosensitive member containing an organic photoconducter, an exposure device, a developing device including a developer, a transfer device and a cleaning device. The photosensitive member employs an organic photoconductor and a polycarbonate resin layer which forms the surface of the photosensitive member. The developer device has a sleeve with a thin layer of an electrical coating material containing dispersed carbon particles. The developer contains insulating magnetic toner particles of relatively small particle size formed from a styrene-acrylic type copolymer or a polyester resin and a magnetic powder.

17 Claims, 4 Drawing Sheets

IMAGE FORMING APPARATUS

FIELD OF THE INVENTION AND RELATED ART

The present invention relates to an image forming apparatus which employs an electrophotographic system and which may be used as a copying machine or a printer.

Conventional image forming apparatus are arranged such that a photosensitive member, such as a photosensitive drum, is surrounded by a primary charging means, an exposure means, a developing means, a transfer means and a cleaning means. The photosensitive constituent of the photosensitive drum may be an organic or inorganic substance. Recently, organic photoconductive (OPC) members have been in wide use as the photosensitive members employed in a general-purpose image forming apparatus because of their low cost and non-polluting properties. After the photosensitive member has been primarily and uniformly charged in the dark, it is exposed to radiation which corresponds to image information to be reproduced so as to form an electrostatic latent image on the photosensitive member. Next, charged particles (toner) are supplied to the photosensitive member in the developing process so as to make the latent image visible by means of the toner. The thus-formed toner image is transferred onto a transfer material, such as a sheet of plain paper (normal paper) or an OHP sheet, in the transfer process, and the toner on the transfer material is thus fixed thereto in the subsequent fixing process. The toner particles which remain on the photosensitive member after the transfer process has been completed are removed from the photosensitive member in the cleaning process so as to ready the photosensitive member for use in a subsequent image forming cycle.

Normally, magnetic toners having a volume-average particle size of less than about 12 microns are employed for the purpose of improving the reproductivity of thin lines, because it is considered that, as the particle size of the magnetic toner decreases, the quantity of triboelectric charge of the toner increases, and that this contributes to the image stability.

However, in the above-described conventional example, the toner particles having a small particle size are so firmly adsorbed onto the surface of the photosensitive member, due to the electrostatic force caused by a relatively high level of self-holding triboelectricity of the toner particles, that they may not be removed completely from the surface of the photosensitive member in the cleaning process. The toner particles remain as a film-like toner layer on the surface of the photosensitive member, greatly deteriorating the photosensitivity of that portion of the photosensitive member and generating cleaning failures.

SUMMARY OF THE INVENTION

An object of the present invention is to provide an image forming apparatus which is capable of eliminating the aforementioned problems of the conventional technique An object of the present invention is to provide an image forming apparatus which exhibits excellent environmental stability.

An object of the present invention is to provide an image forming apparatus which exhibits excellent durability.

An object of the present invention is to provide an image forming apparatus which enables undesired toner filming of the surface of a photosensitive drum to be reduced.

To this end, the present invention provides an image forming apparatus which comprises:

a charging means for primarily charging a photosensitive member which is a first image carrying member;

an exposure means for exposing the photosensitive member to light so as to form a latent image thereon;

a developing means for developing the latent image on the photosensitive member to form a toner image on the photosensitive member, a transfer means for transferring the toner image on the photosensitive member onto a second image carrying member; and a cleaning means for removing toner remaining on the photosensitive member after the transfer has been completed. The photosensitive member includes an organic photoconductor and a layer which contains a second binder resin different from the first binder resin and which forms the surface of the photosensitive member. Also, the developing means includes a developer which contains insulating magnetic toner particles comprising a first binder resin and magnetic powder, wherein the insulating magnetic toner includes:

(i) from about 17–60% by number (N) of magnetic toner particles having a particle size of 5 microns or less; the magnetic toner particles having said particle size of 5 microns or less having a particle size distribution of the formula:

$$N/V = -0.05\,N + k$$

wherein N is as above; V is the percent by volume of the magnetic toner particles having a particle size of 5 microns or less and k is a positive number from 4.6 to 6.7;

(ii) from about 5–50% by number of the magnetic toner particles having a particle size ranging from 6.35 to 10.08 microns;

(iii) the magnetic toner particles having a volume-average particle size from 6 to 9 microns; and (iv) from about 2% by volume or less of the magnetic toner particles having a particle size from 12.70 microns or higher.

Another object of the present invention is to provide a facsimile with the above-described image forming apparatus incorporated therein as a printer.

DETAILED DESCRIPTION OF THE INVENTION

Figure 1A:
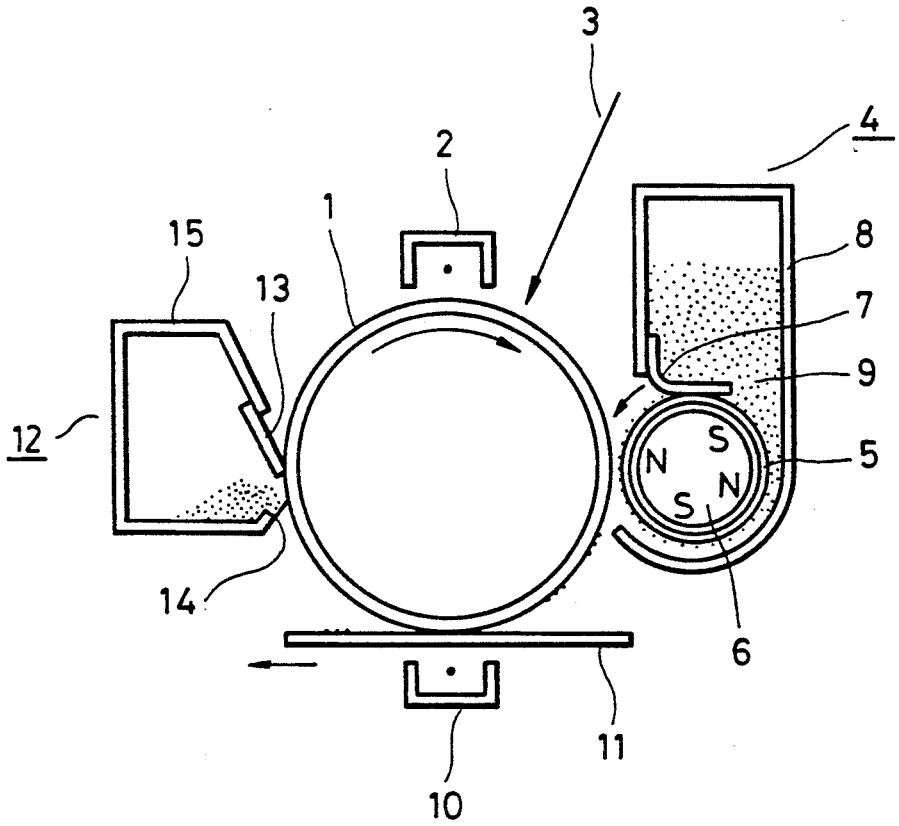
FIG. 1A is a longitudinal cross-sectional view of an image forming apparatus which is employed in one Example of the present invention.

In this invention, a first binder resin which is a constituent of a magnetic toner is selected to be different from a second binder which is a constituent of a layer that forms the surface of an OPC drum, which is a photosensitive drum, so as to eliminate cleaning failure.

Through intensive experiments, the present inventors have found that the above-described cleaning failure easily occurs when the particle size of the toner is small and when the toner is triboelectrically charged at a high level. Such cleaning failure occurred less when the toner had a volume-average particle size of about 12 microns, as in the case of a conventional one. The reasons for this are that the toner which remains on the photosensitive drum after the transfer has been completed cannot be easily removed from the photosensitive drum due to its high level of triboelectricity, and that the presence of toner particles having a small particle size accelerates the possibility of occurrence of the cleaning failure. Furthermore, as the humidity falls, the level to which the toner is triboelectrically charged increases, and the possibility of occurrence of the cleaning failure thus increases. Furthermore, as the level to which the toner is triboelectrically charged increases due to the operation of the image forming apparatus in the continuous printing mode, the possibility of occurrence of the cleaning failure increases.

The present inventors made a series of experiments and found that cleaning failure occurred often when the binder resin contained in the toner was the same as that contained in the photosensitive drum. Although the reasons are not clear, it is considered that a large amount of heat is microscopically generated when the toner remaining on the surface of the drum is scraped by a rubber blade during the blade cleaning, causing the second binder resin contained in the surface layer of the drum, which is heated to a high temperature, to show a high affinity for the first binder resin contained in the toner where these two binder resins are the same. Further, a high level of triboelectricity of the toner and the small particle size of the toner accelerate occurrence of cleaning failure. In the present invention, the binder resin contained in the toner is different from the binder contained in the surface layer of the photosensitive drum. It is therefore possible to reduce the possibility of cleaning failure, which otherwise often occurs when the toner is highly triboelectrically charged and the particle size of the toner powder is small In the image forming apparatus according to the present invention, it is particularly possible to restrict occurrence of cleaning failure under a low humidity environment.

The electrophotographic photosensitive member employed in the image forming apparatus according to the present invention includes a conductive supporting member which acts as a base, and a photosensitive layer containing an organic photoconductive material.

Although the photosensitive layer can be formed in any known form, it is preferable that it is of a function separation type in which a charge generating layer containing a photosensitive compound is laminated on a charge transporting layer containing a charge transporting substance.

The charge generating layer may be formed by applying to the conductive supporting member a coating liquid in which an photosensitive compound and a binder resin are dispersed in an adequate solvent by the known method. The thickness of the charge generating layer may preferably be, for example, 5 microns or less, more preferably, 0.1 to 1 micron.

Examples of such photosensitive compounds which can produce electric charges include azo type pigments, phthalocyanine type pigments, quinone type pigments, and perylene type pigments.

The binder resin which is used together with the photosensitive compound may be an insulating resin or an organic photoconductive polymer. Examples of such resins and polymers include polyvinyl butyral, polyvinyl benzal, polyarylates, polycarbonates, polyesters, phenoxy resins, cellulose resins, acrylic resins and urethane resins.

The binder resin may be used in an amount which is 80 percent by weight, more preferably, 1 to 40 percent by weight, relative to the total weight of the charge generating layer.

The solvent is selected from the substances which dissolve the binder resin but do not dissolve the charge transporting layer or a subbing layer, which will be described later.

Examples of such substances include ethers such as tetrahydrofuran and 1, 4-dioxane; ketones such as cyclohexanone and methyl ethyl ketone; amides such as N, N-dimethylformamide; esters such as methyl acetate and ethyl acetate; aromatic compounds such as toluene, xylene and chlorobenzene; alcohols such as methanol, ethanol and 2-propanol and aliphatic hydrocarbons such as chloroform, methylene chloride, dichloroethylene, carbon tetrachloride and trichloroethylene.

The charge transporting layer is laminated on or under the charge generating layer (preferably, on the charge generating layer), and has the function of receiving charge carriers from the charge generating layer in the presence of an electric field and transporting them onto the surface thereof.

The charge transporting layer may be formed by applying a coating liquid in which an charge transporting substance, together with a desired binder resin, is dissolved in a solvent. The thickness of the charge transporting layer may range from 5 to 40 microns, and more preferably, from 15 to 30 microns.

The charge transporting substance is classified into an electron transporting substance and a positive hole transporting substance. Examples of electron transporting substances include electron absorbing substances such as 2, 4, 7-trinitrofluorenone, 2, 4, 5, 7-tetranitrofluorenone, chloranyl and tetracyanoaurate dimethyl; and polymers of these electron absorbing substances.

Examples of positive hole transporting substances include polynuclear aromatic compounds such as pyrene and anthracene; heterocyclic compounds such as carbazole type compounds, indole type compounds, imidazole type compounds, oxazole type compounds, thiazole type compounds and triazole type compounds; hydrazone type compounds such as p-diethylaminobenzaldehyde-N, N-diphenylhydrazone and N, N-diphenylhydrazine-3-methylidyne-9-ethyl carbazole; styryl type compounds such as α-phenyl-4'-N, N-diphenylaminostilbene and 5-[4-(di-p-tolylamino) benzylidene]-5H-dibenzo [1, d] cycloheptene; benzidine type compounds; triarylmethane type compounds; and triphenylamine.

The above-described charge transporting substances can be used individually or in a combination of two or more of them.

The charge transporting substance is generally used after admixture with the binder resin. Examples of such binder resins include insulating resins such as acrylic resins, polyester, polycarbonate, polystyrene, acrylonitrile-styrene copolymer, polyacrylamide, polyamide and chlorinated rubber. It is preferable for the binder resin employed in the charge transporting layer to have a number-average molecular weight of 20,000 or above.

The constituent of the conductive supporting member may be a metal such as aluminum, aluminum alloy or stainless steel, or an alloy of these metals.

The conductive supporting member may be a plastic on which any of the above-described metals or alloys is coated by a vacuum deposition process; a plastic or a metal on which conductive particles (e.g., carbon black or silver particles) are coated together with a suitable binder resin; or a plastic or paper which is impregnated with conductive particles.

An undercoating layer which acts as a barrier and which also has a binding function may be provided between the conductive supporting member and the photosensitive layer.

The undercoating layer may be formed of casein, polyvinyl alcohol, nitrocellulose, polyamide (nylon 6, nylon 66, nylon 610, copolymerized nylon, alkoxymethyl nylon) polyurethane or aluminum oxide.

The thickness of the undercoating layer is preferably 5 microns or less, more preferably, between 0.1 and 3 microns.

The developer used in the present invention to develop electrostatic images comprises a magnetic toner comprising a binder resin and magnetic powder. The magnetic toner contains 17 to 60% by number of magnetic toner particles having a particle size of 5 microns or less, 5 to 50% by number of magnetic toner particles having a particle size of 6.35 to 10.08 microns, and 2.0% by volume or less of magnetic toner particles having a particle size of 12.70 microns or above.

The magnetic toner also has a volume-average particle size of 6 to 9 microns. The magnetic toner particles having a particle size of 5 microns or less have a particle size distribution satisfying the following formula:

$$N/V = -0.05N + k$$

wherein N denotes the percentage by number of magnetic toner particles having a particle size of 5 microns or less, V denotes the percentage by volume of magnetic toner particles having a particle size of 5 microns or less, k denotes a positive number of 4.6 to 6.7, and N denotes a positive number of 17 to 60.

The binder resin used in the magnetic toner may be a crosslinked styrene type copolymer or a crosslinked polyester.

A comonomer that can be polymerized together with a styrene monomer to manufacture a styrene type copolymer may be a monocarboxylic acid having a double bond or a substitution product thereof, such as acrylic acid, methyl acrylate, ethyl acrylate, butyl acrylate, dodecyl acrylate, octyl acrylate, acrylic acid-2-ethylhexyl, phenyl acrylate, methacrylate, methyl methacrylate, ethyl methacrylate, butyl methacrylate, octyl methacrylate, acrylonitrile, methacrylonitrile or acrylic amide; a dicarboxylic acid having a double bond or a substitution product thereof, such as maleic acid, butyl maleate, methyl maleate or dimethyl maleate; a vinyl ester such as vinyl chloride, vinyl acetate or vinyl benzoate; an ethylene olefin such as ethylene, propylene or butylene; a vinylketone such as vinyl hexylketone or vinylketones; or a vinyl ether such as vinyl methyl ether, vinyl ethyl ether or vinyl isobutyl ether. The above-described vinyl monomers can be used individually or in a combination of two or more of them.

The crosslinking agent is selected from compounds which have two or more polymerizable double bonds. Examples of such compounds include aromatic divinyl compounds such as divinyl benzene and divinyl naphthalene; carboxylic acid esters having two double bonds such as ethylene glycol diacrylate, ethylene glycol dimethacrylate and 1, 3-butanediol dimethacrylate; divinyl compounds such as divinyl aniline, divinyl ether, divinyl sulfide and divinyl sulfone; and compounds having at least three vinyl groups. These compounds can be used individually or in a combination of two or more of them as the crosslinking agent.

It is preferable for the styrene type copolymer which is used in the toner according to the present invention to have a weight-average molecular weight ranging from 50,000 to 2,000,000, and more preferably, from 100,000 to 1,500,000 when dissolved in tetrahydrofuran.

The alcoholic constituent of the polyester resin employed as the binder resin of the toner according to the present invention may be a diol, such as ethylene glycol, diethylene glycol, triethylene glycol, 1, 2-propylene glycol, 2, 3-propylene glycol, 1, 4-butanediol, neopentyl glycol or 1, 4-butanediol; an ether bisphenol such as 1, 4-bis (hydroxymethyl) cyclohexane, bisphenol A, hydrogenated bisphenol A, polyoxyethylene bisphenol A or polyoxypropylene bisphenol A; or any of other dihydroxy alcohol monomers.

The carboxylic acid constituent of the polyester resin may be maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid or the anhydride of any of these acids.

The crosslinking agent which crosslinks the polyester resin may be an aromatic tricarboxylic or higher carboxylic acid, or a tricarboxylic or higher carboxylic acid other than the aromatic tricarboxylic or higher carboxylic acids. Examples of such polycarboxylic acids include trimellitic acid, pyromellitic acid, cyclohexanetricarboxylic acid, 2, 5, 7-naphthalenetricarboxylic acid, 1, 2, 4-naphthalenetricarboxylic acid 1, 2, 5-hexanetricarboxylic acid, 1, 3-dicarboxyl-2-methylenecarboxylpropane, 1, 3-dicarboxyl-2-methyl-2-methylenecarboxylpropane, tetra (methylenecarboxyl) methane, 1, 2, 7, 8-octanetetracarboxylic acid and the anhydrate of any of these substances. The crosslinking agent which crosslinks the polyester resin may also be a trihydric or higher alcohol. Examples of such polyols include sorbitol, 1, 2, 3, 6-hexanetetrol, 1, 4-sorbitol, pentaerythritol, dipentaerythritol, tripentaerythritol, cane suger, 1, 2, 4-butanetriol, glycerine, 2-methylpropanetriol, 2- methyl-1, 2, 4-butanetriol, trimethylolethane and trimethylolpropane and 1, 3, 5-trihydroxybenzene.

It is preferable for the polyester resin employed as the binder resin according to the present invention to have a weight-average molecular weight ranging from 10,000 to 1,000,000, and more preferably, from 20,000 to 800,000 when dissolved in tetrahydrofuran.

The magnetic toner employed in the present invention contains a magnetic powder which may also serve as a coloring agent. Examples of such magnetic powders include iron oxides such as magnetite, γ-iron monoxide, ferrite and iron-rich ferrite, metals such as iron, cobalt and nickel; and alloys and mixtures of any of such metals and a metal which may be aluminum, cobalt, copper, lead, magnesium, tin, zinc, antimony, beryllium, bismuth, cadmium, calcium, manganese, selenium, titanium, tungsten or vanadium.

The average particle size of the magnetic powder is preferably between 0.1 and 1 micron, and more preferably, between 0.1 and 0.5 micron. The magnetic powder is contained in the magnetic toner in an amount ranging from 60 to 110 parts by weight, and more preferably, from 65 to 100 parts by weight, relative to 100 parts by weight of resin constituent.

In the image forming apparatus according to the present invention, a crosslinked styrene type copolymer or a crosslinked polyester resin is used as the binder resin contained in the magnetic toner, while a polycarbonate resin is used as the binder resin contained in the surface layer of the photosensitive member.

The image forming apparatus according to the present invention can also be employed in electrophotographic application fields as, for example, an electrophotographic copying machine, a laser beam printer, a CRT printer, a LED printer, a liquid crystal printer or a laser process.

Figure 3:
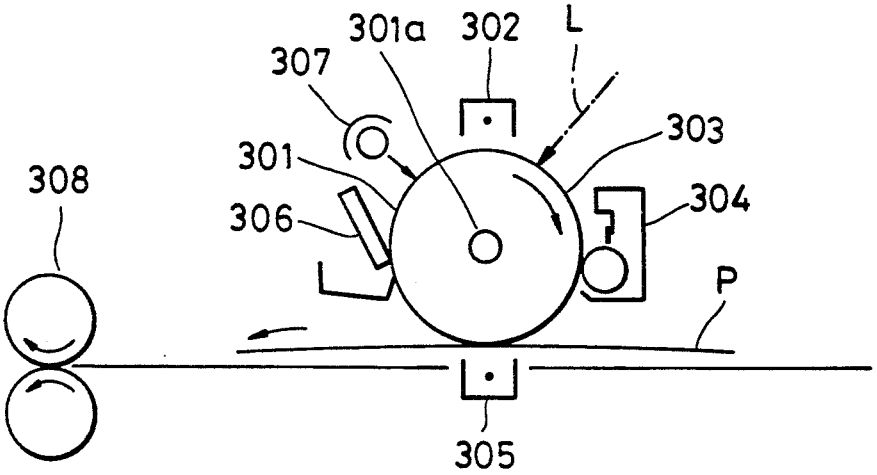
FIG. 3 is a schematic view of another transfer type electrophotographic apparatus according to the present invention.

FIG. 3 schematically shows a generally employed transfer type electrophotographic apparatus which employs a drum-shaped photosensitive member.

In the electrophotographic apparatus shown in FIG. 3, a drum type photosensitive member 301, which is an image carrying member, is rotated about an axis 301*a* in the direction indicated by the arrow at a predetermined circumferential speed. The circumferential surface of the photosensitive member 301 is uniformly charged to a predetermined positive or negative level by a charging means 302 during the rotation. Next, the charged surface is exposed to radiation L (which may be a light obtained by slit exposure or a laser beam which scans the surface of the drum) which is emitted from an exposure means (not shown) in accordance with image information to be reproduced in an exposure section 303, to form an electrostatic latent image on the circumferential surface of the photosensitive member.

The electrostatic latent image formed is developed by a developing means 304, and the thus-obtained toner image is transferred onto the surface of a transfer material P, which is fed to the space between the photosensitive member 301 and a transfer means 305 from a paper feeding section (not shown) in synchronism with the rotation of the photosensitive member 301, by means of the transfer means 305.

The transfer material P onto which the toner image has been transferred is separated from the surface of the photosensitive member and then fed to a toner image fixing means 308 so as to fix the toner image onto the surface of the transfer material P. The resultant sheet of paper is fed out of a machine as a copy.

The toner remaining on the surface of the photosensitive member 301 after the transfer process has been completed is removed by a cleaning means 306 so as to ready the photosensitive member for use in a subsequent image forming cycle.

A corona charger is generally used as the means 302 for uniformly charging the photosensitive member 301. Also, a corona transfer means is widely used as the transfer means 305. The electrophotographic apparatus may be constructed such that a plurality of components, including the photosensitive member, the developing means and the cleaning means, are formed as one unit and that unit is made detachable with respect to the body. For example, the photosensitive member 301 and the cleaning means 306 may be formed as one unit which can be mounted on or detached from the body by means of a guide means such as a rail provided in the body. At that time, the charging means and/or the developing means may also be mounted on that unit.

In a case where the electrophotographic apparatus is used as a copying machine or a printer, the radiation L may be, for example, a light reflected by or passed through an original document; a laser beam which represents a signal obtained by reading the original document; a light emitted from a light-emitting diode; or a light emitted from a liquid crystal shutter array.

Figure 4:
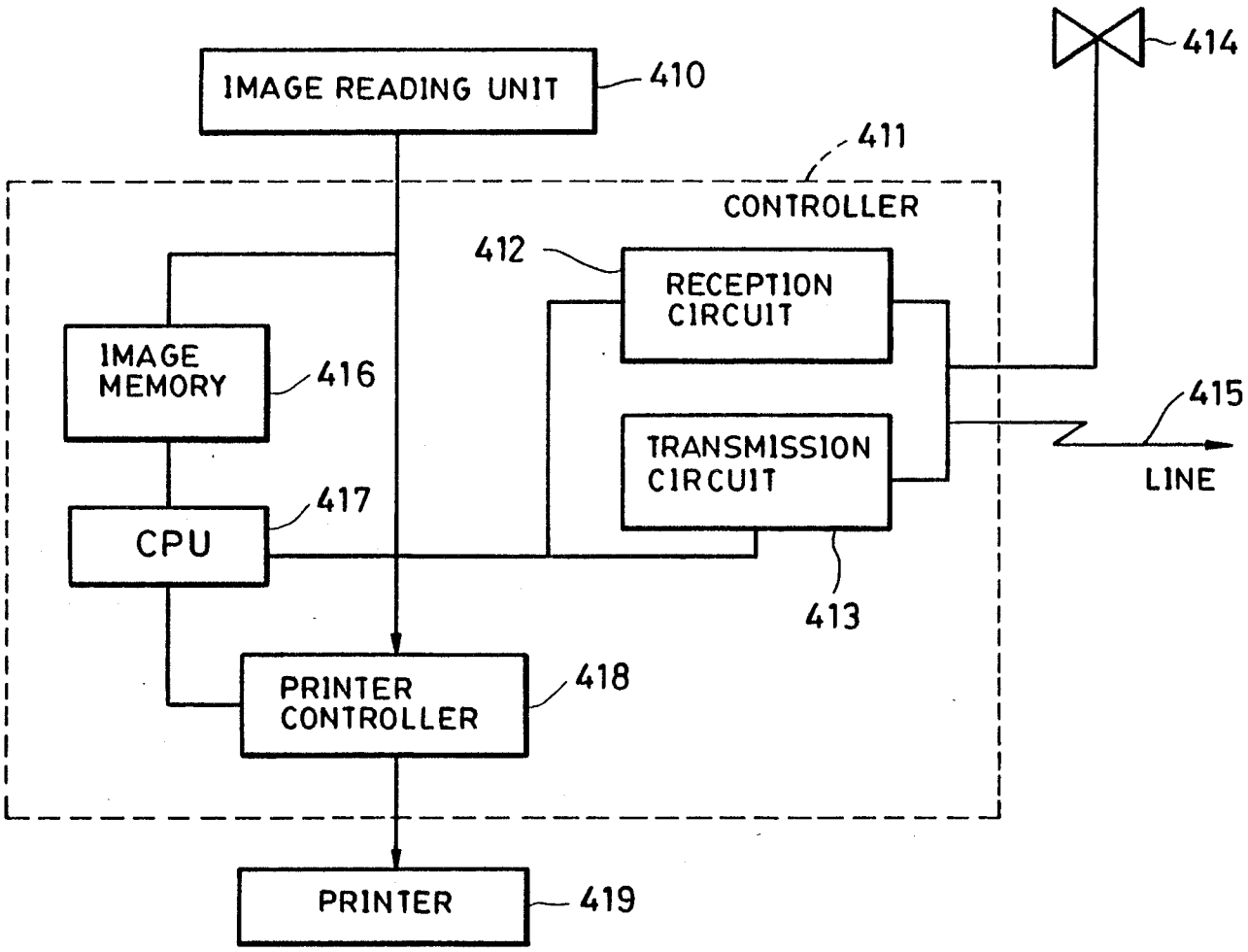
FIG. 4 is a block diagram of a facsimile which employs as a printer the electrophotographic apparatus according to the present invention.

In a case where the electrophotographic apparatus is employed as a printer for a facsimile, the radiation L represents the light employed to print out data received by the facsimile. FIG. 4 is a block diagram of an electrophotographic apparatus which is used as the printer for a facsimile.

A controller 411 controls both an image reading unit 410 and a printer 419. The controller 411 is controlled by a central processing unit (CPU) 417. The data read by the image reading unit 410 is transmitted to a remote terminal through a transmission circuit 413. The data received from a remote terminal is sent to the printer 419 through a reception circuit 412. An image memory stores a predetermined amount of image data. A printer controller 418 controls the printer 419. A reference numeral 414 denotes a telephone.

The data received through a communication line 415 (from the remote terminal connected to this facsimile machine through the communication line) is demodulated by the reception circuit 412. The demodulated image information is decoded by the CPU 417, and the decoded image information is stored in the image memory 416. Once the image information corresponding to one page has been stored in the image memory 416, recording of that image is performed, the CPU 417 reads out the image information corresponding to one page from the image memory 416 and sends the decoded information to the printer controller 418. The printer controller 418 receives the image information corresponding to one page from the CPU 417 and controls the printer 419 so that recording of the image information can be performed.

The CPU 417 receives image information representing a subsequent page while the printer 419 is recording the image information.

Reception and recording of an image is thus performed.

EXAMPLE 1

The following ingredients were used to manufacture an insulating magnetic toner.

| | |
|---|---|
| Styrene/butyl acrylate/divinyl benzene copolymer (copolymerization weight ratio: 80/19.5/0.5, the weight-average molecular weight: 320,000) | 100 parts by weight |
| Triiron tetroxide (having an average particle size of 0.2 micron) | 80 parts by weight |
| Cr complex of an azo pigment (Bontron S-34, mfd. by Orient Kagaku Kogyo K.K.) | 1 part by weight |
| Low molecular weight propylene-ethylene copolymer | 4 parts by weight |

These ingredients were mixed and kneaded, and the mixture was roughly pulverized, finely pulverized, and then classified into fractions to obtain powder (magnetic toner) having the following particle size distribution:

(i) 5 microns or less: 35.4% by number
(ii) 6.35 to 10.08 microns: 36.9% by number
(iii) 16 microns or above: 0.5% by volume
(iv) Volume-average particle size: 6.5 microns
(v) N/V=3.5

The particle size distribution of the magnetic toner was measured by Coulter Counter TA-II (aperture 100 μm).

1.2 parts by weight of colloidal silica (fine powder), which was subjected to dimethyl silicon oil, was added to 100 parts by weight of the thus-obtained powder (magnetic toner), and the mixture was mixed to obtain a one-component insulating magnetic toner containing colloidal silica fine powder which can be charged to a negative polarity.

The function-separating type OPC drum, which had the following structure, was used as the photosensitive drum.

Charge generating layer: a bis-azo pigment and an ester resin

Charge transporting layer: (surface layer)

Charge transporting material:

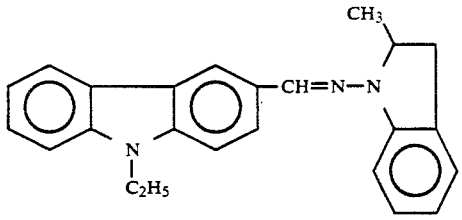

Binder resin: bisphenol A type polycarbonate resin (number-average molecular weight: 30,000)

The image forming apparatus shown in FIG. 1A was used The photosensitive drum had a diameter of 30 mm. The drum was rotated at a process speed of 100 mm/sec. After the drum was primarily charged to −650 V by a corona charger, it was exposed to a laser beam of 3.0 μJ/cm$^2$ so as to form an electrostatic latent image whose bright and dark portions respectively had potentials −150 V and −650 V. The thus-obtained electrostatic latent image was reversely developed using the one-component magnetic toner which was triboelectrically charged to a negative polarity.

The cleaning blade employed was a plate formed of urethane rubber. The plate had a thickness of 2.0 mm. The cleaning blade was in contact with the photosensitive drum in a direction opposite to that in which it was rotated. The cleaning blade was pressed against the drum with free contact length of 5 mm and under the pressure of 20 g/cm.

We conducted printing tests by conducting printing at an image ratio of 5% on the transfer material which were sheets of A4 size plain paper fed in their longitudinal direction. The printing tests were conducted under the conditions of (i) low temperature and low humidity, (ii) normal temperature and normal humidity and (iii) high temperature and high humidity and in both continuous and intermittent operation modes. In each case, no cleaning failure occurred in the 10,000 sheets of paper and excellent prints were obtained. The quantity of triboelectric charge of the magnetic toner was calculated from the current value which flowed when the toner thin layer on the developing sleeve was transferred and the amount of toner transferred, and obtained the following values under the above-described conditions.

| | Condition | | |
|---|---|---|---|
| | Temperature: 15° C. Humidity: 10% (RH) | Temperature: 23° C. Humidity: 60% (RH) | Temperature: 35° C. Humidity: 80% (RH) |
| Quantity | −12.0 μc/g | −8.0 μc/g | −6.0 μc/g |

In this example, the binder resin in the magnetic toner was styrene-butyl acrylate copolymer which was cross-linked by divinylbenzene, whereas the binder resin in the surface layer of the photosensitive drum was polycarbonate resin. They are different in their properties, and no cleaning failure occurred.

FIG. 1A schematically shows the image forming apparatus employed in Example 1. In FIG 1A which is a vertical cross-section of the image forming apparatus, a photosensitive drum 1 is rotated in the direction indicated by the arrow. The photosensitive drum 1 is uniformly charged by a primary charger 2, and the charged drum is then exposed to a laser beam 3 to form a latent image A developer station 4 is arranged such that a toner 9 is thinly coated on a sleeve 5, which is a non-magnetic stainless pipe 16 with a an electrically conductive conductive coating layer 17 coated thereon, by means of an elastic blade 7. A fixed magnet is provided within the sleeve 5 so as to prevent background fog which would occur during the development. The other pole of the magnet is used to smoothly carry the magnetic toner 9 along the surface of the rotating sleeve. The magnetic toner 9, which is the main characteristic of the present invention, is accommodated in a developing housing 9. The electrostatic latent image is developed by the magnetic toner supplied from the developer station 4, and the thus-obtained toner image is transferred onto a sheet of transfer paper 11 from the surface f the drum 1 by the action of a transfer charger 10. A small amount of magnetic toner which remains on the surface of the drum 1 is removed by a cleaning device 12. The cleaning device 12 has a cleaning blade 13 formed of an elastic material such as urethane rubber. The cleaning blade is in contact with the surface of the drum 1 in a direction opposite to that in which it is rotated. The magnetic toner which is scraped is received by a receiving sheet 14 formed of an elastic film and accommodated in a cleaner housing 15.

Figure 1B:
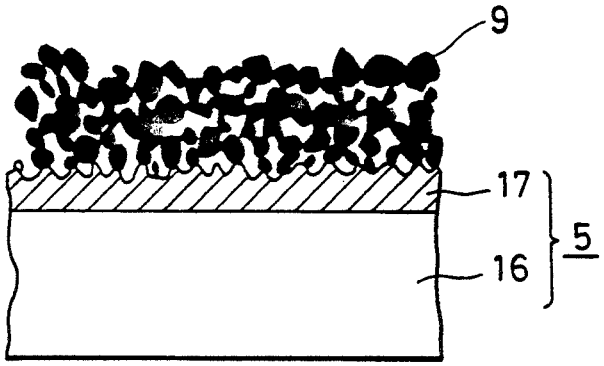
FIG. 1B illustrates an embodiment in which a toner is coated on a developing sleeve.

FIG. 1B shows the magnetic toner 9 coated in a thin layer on the developing sleeve 5. The developing sleeve 5 is the stainless steel pipe 16 with the conductive coating layer 17 having an irregular surface formed thereon. The conductive coating layer 17 is formed by coating a conducting paint containing carbon particles on the pipe 16. The developing sleeve 5 discourages adsorption of the magnetic toner 9 according to the present invention which is highly triboelectrically charged du to the electrostatic force of the toner, and hereby implements excellent development.

Figure 1C:
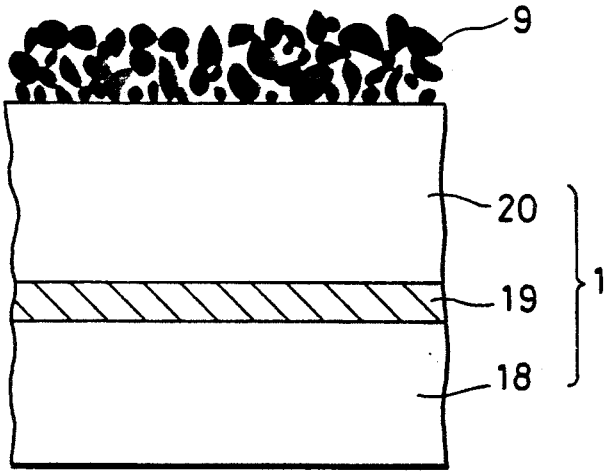
FIG. 1C illustrates an embodiment in which the toner is attached to the surface of a photosensitive drum.

FIG. 1C shows the magnetic toner 9 attached to the photosensitive drum 1 to form a toner image. The photosensitive drum 1 includes a base plate 18 made of aluminum, a charge generating layer 19 formed on the base plate and a charge transporting layer 20 formed on the charge generating layer 19. In this example, the binder resin in the charge transporting layer 20 was polycarbonate resin, and the binder resin in the magnetic toner was styrene-acrylate copolymer.

COMPARISON EXAMPLE

A function-separating type OPC drum was used as the photosensitive drum. The binder present in the surface layer of the drum was styrene-acrylatecopolymer. The drum had a diameter of 30 mm. The drum was driven at a process speed of 100 mm/sec. The drum was charged to −650 V by the primary charger, and the charged drum was exposed to a laser beam of 3.0 $\mu J/cm^2$ so as to form a latent image whose bright and dark portions had −150 V and −650 V, respectively. The thus-obtained latent image was reversely developed using a negatively charged one-component magnetic toner. The magnetic toner employed has the following particle size distribution.

(i) 5 microns or less: 35.4% by number
(ii) 6.35 to 10.08 microns: 36.9% by number
(iii) 12.70 microns or above: 0.5% by volume
(iv) Volume-average particle size 6.5 microns
(v) N/V=3.5

The binder resin contained in this magnetic toner was styrene-acrylate copolymer.

The cleaning blade employed was a plate formed of urethane rubber. The plate had a thickness of 2.0 mm. The cleaning blade was in contact with the photosensitive drum in a direction opposite to that in which it was rotated. The cleaning blade was pressed against the drum with free contact length of 5 mm and under the pressure of 20 g/cm.

Printing was conducted on 10,000 sheets of A4 size common paper which were fed in their longitudinal direction at an image ratio of 5% under each of the following conditions and in each of continuous and intermittent operation modes. The following result were obtained:

| | Condition | | |
|---|---|---|---|
| | Temperature: 15° C. Humidity: 10% (RH) | Temperature: 23° C. Humidity: 60% (RH) | Temperature: 35° C. Humidity: 80% (RH) |
| Continuous | A cleaning failure occurred after 500 sheets were printed | A cleaning failure occurred after 3,000 sheets were printed | No cleaning failure occurred |
| Intermittent | A cleaning failure occurred after 2,000 sheets were printed | A cleaning failure occurred after 8,000 sheets were printed | No cleaning failure occurred |

In this example, the binder resin contained in the magnetic toner and the binder resin contained in the surface layer of the photosensitive drum were identical styrene-acrylate copolymer, so cleaning failures occurred.

The quantity of triboelectric charge of the magnetic toner placed on the sleeve was −12 μc/g at low temperature and low humidity, −8 μc/g at normal temperature and normal humidity, and −6 μc/g at high temperature and high humidity.

EXAMPLE 2

The following ingredients were used to manufacture a magnetic toner.

| | |
|---|---|
| Crosslinked polyester resin (Mw 50,000, Tg 60° C.) [Main alcoholic constituent: bisphenol A type dihydroxy alcohol, main acid constituent: terephthalic acid] | 100 parts by weight |
| 3.5-di-t-butylsalicylic acid metal salt | 1 part by weight |
| Triiron tetroxide (having an average particle size of 0.2 micron) | 70 parts by weight |
| Low molecular weight polypropylene-ethylene copolymer | 3 parts by weight |

These ingredients were mixed and kneaded, and the mixture was roughly pulverized, finely pulverized, and then classified into fractions to obtain powder (magnetic toner) having the following particle size distribution:

(i) 5 microns or less:40% by number
(ii) 6.35 to 10.08 microns:12% by number
(iii) 16 microns or above:0.5% by volume
(iv) Volume-average particle size:7.0 microns
(v) N/V=3.9

0.6 part by weight of negatively charged hydrophobic colloidal silica (fine powder) was added to 100 parts by weight of the thus-obtained powder (magnetic toner) to obtain a one-component magnetic toner.

The function-separating type OPC drum, which had the following structure, was used as the photosensitive drum.

Charge generating layer: a tri-azo pigment and an ester resin

Charge transporting layer: (surface layer)

Charge transporting material:

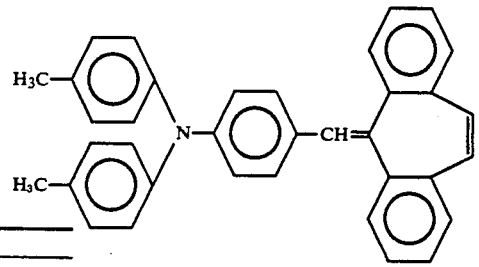

Binder resin: bisphenol A type polycarbonate resin (number-average molecular weight: 30,000)

Figure 2:
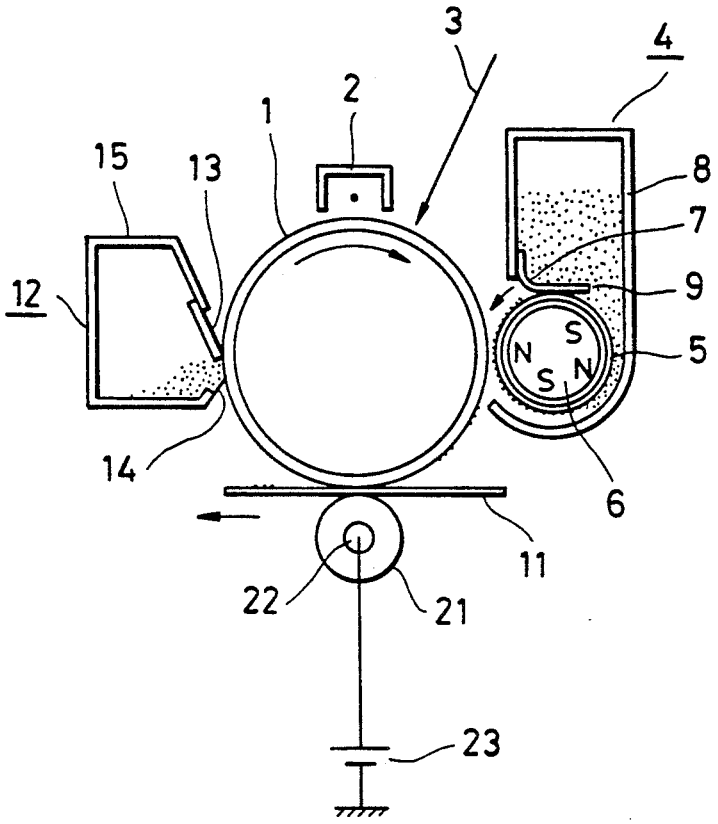
FIG. 2 shows the image forming apparatus which is employed in another aspect of the present invention.

The image forming apparatus shown in FIG. 2 was used. Unlike the apparatus employed in Example 1, this image forming apparatus adopted the roller transfer method. A toner image was transferred onto the transfer material 11 by applying a high voltage from a high voltage power source 23 to a core metal 22 of a transfer roller 21. When compared with the corona transfer method adopted in Example 1, this roller transfer method has advantages in that transfer can be performed at a low electric field, that scattering around the printed characters, which occurs during the transfer, can be reduced, and that image blurring, which occurs while the transfer material is conveyed, can be eliminated. When printing was conducted on 10,000 sheets of paper under the process conditions which were the same as those of Example 1 with the exception that the photosensitive drum was driven at a process speed of 50 mm/sec under each of the three types of environments (temperature: 15° C., humidity: 10% RH; temperature: 23° C., humidity: 60% RH; temperature: 35° C., humidity: 80% RH) and in each of continuous and intermittent operation modes, no cleaning failure occurred, and excellent images were obtained in all cases.

As will be understood from the foregoing description, occurrence of cleaning failure can be eliminated by making the binder resin contained in the magnetic toner having a small particle size different from the binder resin contained in the surface layer of the photosensitive drum.

What is claimed is:

1. An image forming apparatus comprising:

(a) a charging means for primarily charging a photosensitive member which is a first image carrying member wherein said photosensitive member includes an organic photoconductive material and a layer forming the surface of said photosensitive member, said layer comprising a polycarbonate resin;

(b) an exposure means for exposing said photosensitive member to light so as to form a latent image thereon;

(c) a developing means for reversely developing the latent image on said photosensitive member to form a toner image on said photosensitive member, wherein said developing means comprises (i) a sleeve having a surface layer of a thin layer of electrical conductive material containing carbon particles dispersed therein which forms an irregular surface and (ii) a developer supported on said thin layer containing insulating magnetic toner particles triboelectrically chargeable to a negative polarity comprising (a) a styrene-acrylic type copolymer or a polyester resin and (b) magnetic powder, wherein said insulating magnetic toner includes:

(i) from about 17–60% by number (N) of said magnetic toner particles having a particle size of 5 microns or less; said magnetic toner particles having said particle size of 5 microns or less having a particle size distribution of the formula:

$$N/V = -0.05\,N + k$$

wherein N is as above; V is the percent by volume of said magnetic toner particles having a particle size of 5 microns or less and k is a positive number from 4.6 to 6.7;

(ii) from about 5–50% by number of said magnetic toner particles having a particle size ranging from 6.35 to 10.08 microns;

(iii) said magnetic toner particles having a volume-average particle size from 6 to 9 microns;

(iv) from about 2% by volume or less of said magnetic toner particles having a particle size from 12.70 microns or higher;

(d) a transfer means for transferring the toner image on said photosensitive member onto a second image carrying member; and (e) a cleaning means for removing toner particles remaining on said photosensitive member after the transfer has been completed.

2. The image forming apparatus according to claim 1, wherein said magnetic toner contains a styrene-acrylic type copolymer.

3. The image forming apparatus according to claim 1, wherein said magnetic toner contains a crosslinked styrene-acrylic type copolymer.

4. The image forming apparatus according to claim 1, wherein said magnetic toner contains a crosslinked styrene-acrylate copolymer.

5. The image forming apparatus according to claim 1, wherein said magnetic toner contains a crosslinked styrene-methacrylate copolymer.

6. The image forming apparatus according to claim 1, wherein said magnetic toner contains a polyester resin.

7. The image forming apparatus according to claim 1, wherein said magnetic toner contains a crosslinked polyester resin.

8. The image forming apparatus according to claim 1, wherein said photosensitive member is in the form of a drum and includes a conductive supporting member, a charge generating layer, and a charge transporting layer.

9. The image forming apparatus according to claim 8, wherein said photosensitive drum has a charge transporting layer as the surface layer, and wherein said charge transporting layer contains a polycarbonate resin.

10. The image forming apparatus according to claim 1, wherein said magnetic toner contains a styrene-acrylic type copolymer, said photosensitive member has charge transporting layer as the surface layer, and said charge transporting layer contains a polycarbonate resin.

11. The image forming apparatus according to claim 10, wherein said styrene-acrylic type copolymer comprises a crosslinked styrene-acrylic type copolymer.

12. The image forming apparatus according to claim 10, wherein said magnetic toner contains a crosslinked polyester resin.

13. The image forming apparatus according to claim 1, wherein said magnetic toner contains a polyester resin as the first binder resin, said photosensitive member has a charge transporting layer as the surface layer, and said charge transporting layer contains a polycarbonate resin.

14. The image forming apparatus according to claim 1, wherein said photosensitive member is in the form of a drum which carries a negative electrostatic latent image.

15. The image forming apparatus according to claim 1, wherein said cleaning means has a cleaning blade.

16. The image forming apparatus according to claim 15, wherein said cleaning blade is made of urethane rubber.

17. A facsimile machine comprising an electrophotographic apparatus and a reception means for receiving image information from a remote terminal, said photoelectric apparatus comprising:

(a) a charging means for primarily charging a photosensitive member which is a first image carrying member, wherein said photosensitive member includes an organic photoconductive material and a layer forming the surface of said photosensitive member, said layer comprising a polycarbonate resin;

(b) an exposure means for exposing said photosensitive member to light so as to form a latent image thereon;

(c) a developing means for reversely developing the latent image on said photosensitive member to form a toner image on said photosensitive member, wherein said developing means comprises (i) a sleeve having a surface layer of a thin layer of an electrical conductive material containing carbon particles dispersed therein, which forms an irregular surface and (ii) a developer supported on said thin layer, containing insulating magnetic toner particles triboelectrically chargeable to a negative polarity comprising (a) a styrene-acrylic type copolymer or a polyester resin and (b) magnetic powder, wherein said insulating magnetic toner includes:

(i) from about 17–60% by number (N) of said magnetic toner particles having a particle size of 5 microns or less, said magnetic toner particles having said particle size of 5 microns or less having a particle size distribution of the formula:

$$N/V = -0.05\,N + k$$

wherein N is as above; V is the percent by volume of said magnetic toner particles having a particle size of 5 microns or less and k is a positive number from 4.6 to 6.7;

(ii) from about 5–50% by number of said magnetic toner particles having a particle size ranging from 6.35 to 10.08 microns;

(iii) said magnetic toner particles having a volume-average particle size from 6 to 9 microns;

(iv) from about 2% by volume or less of said magnetic toner particles having a particle size from 12.70 microns or higher;

(d) a transfer means for transferring the toner image on said photosensitive member onto a second image carrying member; and (e) a cleaning means for removing toner remaining on said photosensitive member after the transfer has been completed.

* * * * *

UNITED STATES PATENT AND TRADEMARK OFFICE

CERTIFICATE OF CORRECTION

PATENT NO. : 5,157,442

DATED : October 20, 1992

INVENTOR(S) : KOICHI TANIGAWA, ET AL.

It is certified that error appears in the above-identified patent and that said Letters Patent is hereby corrected as shown below:

IN [57] ABSTRACT

Line 3, "photoconducter" should read --photoconductor--.

COLUMN 4

Line 40, "an" should read --a--.

COLUMN 5

Line 8, "above" should read --above.--.

COLUMN 9

Line 47, "used" should read --used.--.

COLUMN 10

Line 33, "image" should read --image.--.
Line 35, "a" should be deleted.
Line 36, "conductive conductive" should read --conductive--.
Line 44, "developing housing 9." should read --developer housing 8.--.
Line 49, "f" should read --of--.
Line 66, "du" should read --due--.

COLUMN 11

Line 14, "styrene-acrylatecopolymer" should read --styrene-acrylate copolymer--.

--

UNITED STATES PATENT AND TRADEMARK OFFICE

CERTIFICATE OF CORRECTION

PATENT NO. : 5,157,442

DATED : October 20, 1992

INVENTOR(S) : KOICHI TANIGAWA, ET AL.

It is certified that error appears in the above-identified patent and that said Letters Patent is hereby corrected as shown below:

COLUMN 14

Line 45, "charge" should read --a charge--.

Signed and Sealed this

Seventh Day of December, 1993

Bruce Lehman

*Attest:*

BRUCE LEHMAN

*Attesting Officer*

*Commissioner of Patents and Trademarks*